US011270611B2

(12) United States Patent
Xiao

(10) Patent No.: US 11,270,611 B2
(45) Date of Patent: Mar. 8, 2022

(54) TEST METHOD AND DEVICE OF DATA MISCHARGING OF DISPLAY PANEL

(71) Applicant: TCL CHINA STAR OPTOELECTRONICS TECHNOLOGY CO., LTD, Guangdong (CN)

(72) Inventor: Guangxing Xiao, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 16/968,930

(22) PCT Filed: May 14, 2020

(86) PCT No.: PCT/CN2020/090330
§ 371 (c)(1),
(2) Date: Aug. 11, 2020

(87) PCT Pub. No.: WO2021/203523
PCT Pub. Date: Oct. 14, 2021

(65) Prior Publication Data

US 2021/0319731 A1 Oct. 14, 2021

(30) Foreign Application Priority Data

Apr. 10, 2020 (CN) ..... 202010280135.3

(51) Int. Cl.
*G09G 3/00* (2006.01)
*G09G 3/36* (2006.01)

(52) U.S. Cl.
CPC ..... *G09G 3/006* (2013.01); *G09G 3/3648* (2013.01)

(58) Field of Classification Search
CPC ..... G09G 3/006; G09G 3/3648
See application file for complete search history.

(56) References Cited

U.S. PATENT DOCUMENTS

2010/0053494 A1* 3/2010 Li ..... G02F 1/133382 349/60
2010/0188418 A1* 7/2010 Sakai ..... G01J 3/50 345/594
2013/0342431 A1* 12/2013 Saeedi ..... G09G 3/006 345/89
2015/0109347 A1* 4/2015 Wen ..... G09G 3/3607 345/690

* cited by examiner

*Primary Examiner* — Mark W Regn
(74) *Attorney, Agent, or Firm* — Mark M. Friedman

(57) ABSTRACT

The present invention provides a test method and a device of data mischarging of a display panel. The test method includes: a personal computer (PC) controlling a pixel group to output a screen with a solid color; controlling a charging time of a master device to be constant and adjusting a charging time of a timing controller; determining whether a measurement data of an optical test instrument is greater than a first threshold and detecting whether an obvious boundary appears in a middle of the display panel, and determining a mischarging time if so.

20 Claims, 4 Drawing Sheets

FIG. 1, Prior Art

TEST METHOD AND DEVICE OF DATA MISCHARGING OF DISPLAY PANEL

FIELD OF INVENTION

The present invention is related to the field of test technology of display panels, and specifically, to a test method and a device of data mischarging of a display panel.

BACKGROUND OF INVENTION

With development of panel industry, large-size display panels are being developed rapidly. Data signals from a source driver need to reach a gate driver circuit corresponding to a pixel circuit through a long transmission path. Affected by resistance/capacitance on the transmission path such as a data line, when the data signals reach the gate driver circuit at different positions, a delay occurs.

If a charging time of all pixels in a display panel is in accordance with a standard charging time, the delay of the data signal causes mischarging of some pixels. The standard charging time refers to a charging time required for a pixel to reach a specific brightness under a specific gray-scale voltage. The specific brightness refers to a corresponding brightness of the specific gray-scale voltage within a curve of a gray-scale voltage to a luminous brightness.

As shown in FIG. 1 of the prior art, a clock signal ck is a slowly decreasing curve due to a capacitive coupling effect at screen ends. If a ck of a current row is not turned off, and a next row starts to send data, data of the next row will be displayed in the current row, which means that the mischarging occurs. A time point at which the current row can actually turn off the ck is called a mischarging point. Therefore, it is necessary to test a mischarging time of a thin-film transistor liquid crystal display (TFT-LCD). However, there is currently no effective solution for testing a data mischarging of the display panel.

SUMMARY OF INVENTION

When a display panel in the prior is charged, a problem of data mischarging occurs.

A test method of a data mischarging of a display panel provided by the present invention includes:

S1, connecting an optical test instrument to the display panel and heating the display panel, and a personal computer (PC) controlling a pixel group to output a screen with a solid color through a bus when a heating time of the display panel is greater than a second threshold;

S2, the PC controlling a charging time of a timing controller to be constant and updating a charging time of a master device to be same as the charging time of the timing controller;

S3, the PC controlling the charging time of the master device to be constant and adjusting a charging pulse width of the timing controller according to a charging pulse width sent by a micro control unit to adjust the charging time of the timing controller;

S4, the PC determining whether a measurement data of the optical test instrument is greater than a first threshold, proceeding to step S5 if the measurement data of the optical test instrument is greater than the first threshold, and proceeding to step S2 if the measurement data of the optical test instrument is less than or equal to the first threshold; and S5, detecting whether a boundary appears on the display panel, determining a mischarging time if so, and proceeding to step S2 if not.

A test method of a data mischarging of a display panel provided by the present invention includes:

S1, a personal computer (PC) controlling a pixel group to output a screen with a solid color;

S2, the PC controlling a charging time of a timing controller (TCON) to be constant and updating a charging time of a master device to be same as a charging time of the TCON;

S3, the PC controlling the charging time of the master device to be constant and adjusting the charging time of the TCON;

S4, the PC determining whether a measurement data of an optical test instrument is greater than a first threshold, proceeding to step S5 if the measurement data of the optical test instrument is greater than the first threshold, and proceeding to step S2 if the measurement data of the optical test instrument is less than or equal to the first threshold; and S5, detecting whether a boundary appears on the display panel, determining a mischarging time if so, and proceeding to step S2 if not.

A test device of data mischarging of a display panel further provided by the present invention includes: a personal computer (PC), a display panel, an optical test instrument, the timing controller (TCON) module, a pixel group, a communication interface, and one or more programs; wherein the one or more programs are stored in the PC and are configured to be executed by the TCON module, and the one or more programs are configured to be executed by the TCON module for:

the PC controlling the pixel group to output a screen with a solid color;

the PC controlling a charging time of a timing controller to be constant and updating a charging time of a master device to be same as the charging time of the timing controller;

the PC controlling the charging time of the master device to be constant and adjusting the charging time of the timing controller;

the PC determining whether a measurement data of the optical test instrument is greater than a first threshold, detecting whether a boundary appears on the display panel if the measurement data of the optical test instrument is greater than the first threshold, and the PC controlling the charging time of the timing controller to be constant and updating the charging time of the master device to be same as the charging time of the timing controller if the measurement data of the optical test instrument is less than or equal to the first threshold; and determining a mischarging time if the boundary appears on the display panel, and the PC controlling the charging time of the timing controller to be constant and updating the charging time of the master device to be same as the charging time of the timing controller if no boundary appears on the display panel.

The present invention can be used to quickly and effectively determine whether the data mischarging occurs to the display and can effectively obtain the mischarging time of data. According to the mischarging time, a technical problem of the data mischarging of the display panel in the prior art can be solved.

DETAILED DESCRIPTION OF PREFERRED EMBODIMENTS

To further explain the technical means and effect of the present invention, the following refers to embodiments and drawings for detailed description. Obviously, the described embodiments are only for some embodiments of the present invention, instead of all embodiments. All other embodiments based on embodiments in the present invention and obtained by those skilled in the art without creative efforts are within the scope of the present invention.

In the specification, the claims, and the accompanying drawings, the terms "first", "second", and so on are intended to distinguish between similar objects, rather than indicate a specific order or a time order. Moreover, the terms "include", "have" and any variant thereof mean to cover the non-exclusive inclusion. For example, a process, a method, a device, a product, or a terminal that includes a series of steps or units is not limited to the listed steps or units, but optionally further includes an unlisted step or unit, or optionally further includes another inherent step or unit of the process, the method, the device, the product, or the terminal.

"Embodiment" mentioned herein means that particular features, structures, or characteristic described with reference thereto may be included in at least one implementation of the present invention. Appearances of such phrases in various places of the specification do not necessarily refer to the same implementation, nor refer to separate or alternative implementations that are mutually exclusive with other implementations. It is explicitly and implicitly understood by those skilled in the art that the implementations described herein may be combined with other implementations.

Figure 1:
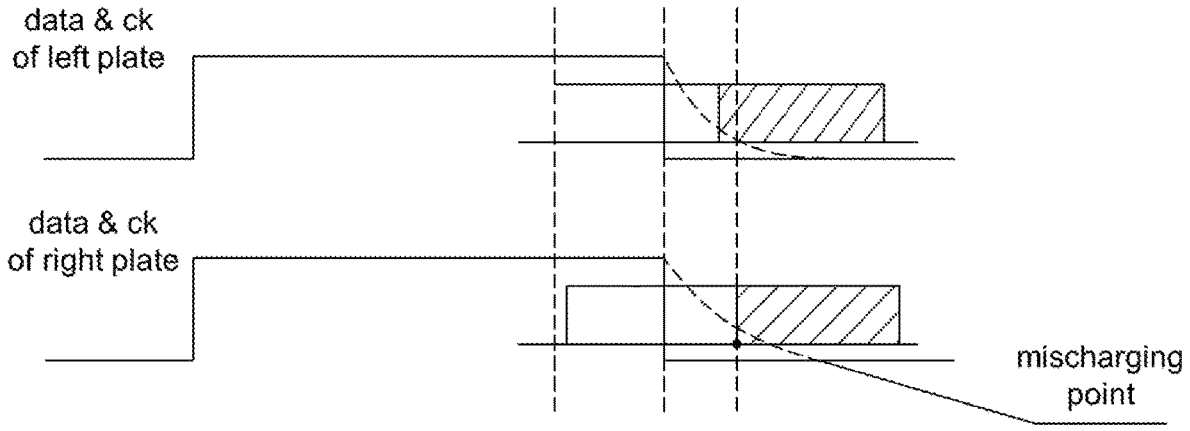
FIG. 1 is a schematic diagram of a mischarging time of a display panel disclosed in the prior art.
Figure 2:
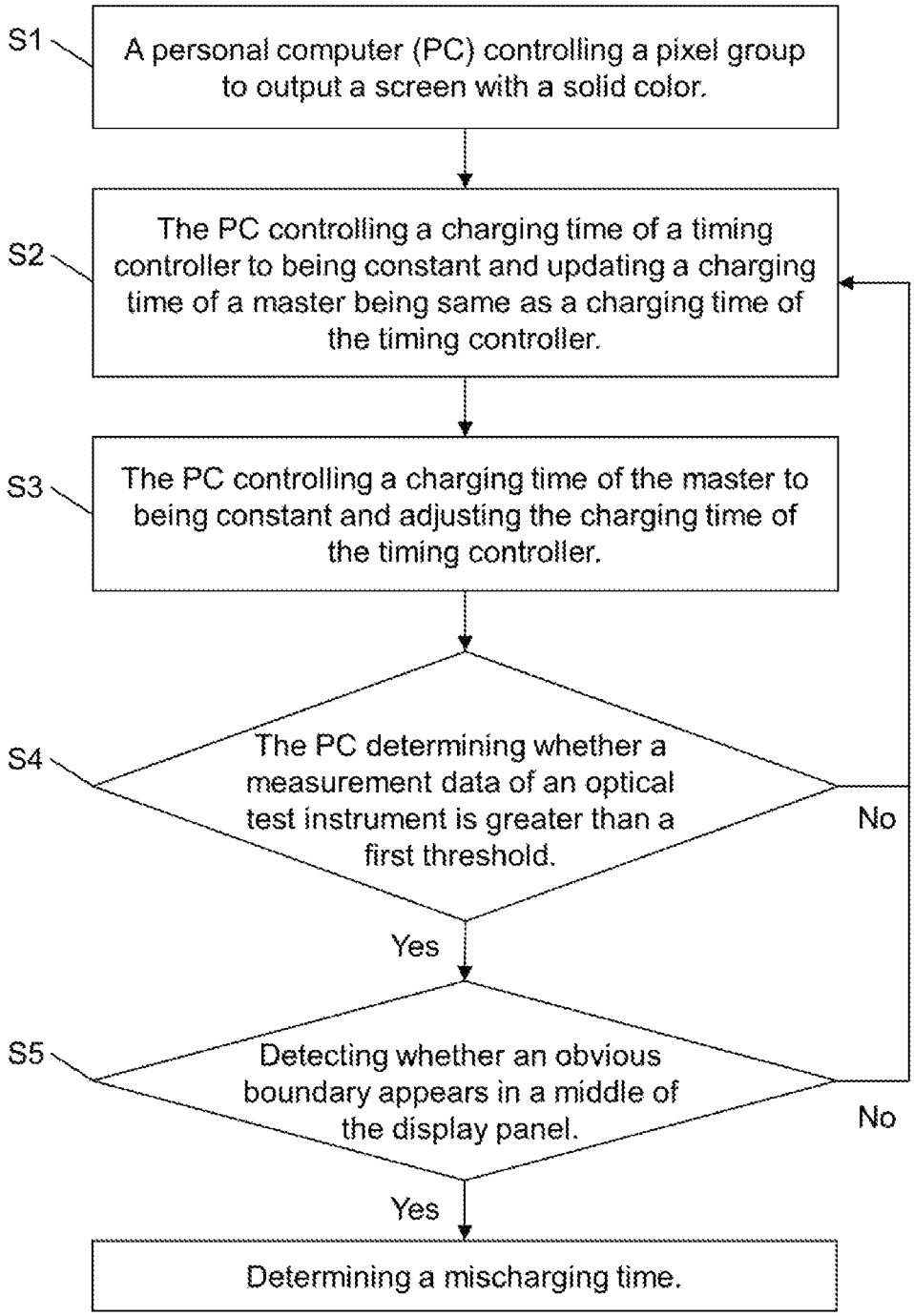
FIG. 2 is a flowchart of a test method of data mischarging of a display panel disclosed in an embodiment of the present invention.

As shown in FIG. 2, a test method of data mischarging of a display panel disclosed by the present invention includes:

S1, a personal computer (PC) controlling a pixel group to output a screen with a solid color;

S2, the PC controlling a charging time of a timing controller to be constant and updating a charging time of a master device to be same as the charging time of the timing controller;

S3, the PC controlling the charging time of the master device to be constant and adjusting the charging time of the timing controller;

S4, the PC determining whether a measurement data of an optical test instrument is greater than a first threshold, proceeding to step S5 if the measurement data of the optical test instrument is greater than the first threshold, and proceeding to step S2 if the measurement data of the optical test instrument is less than or equal to the first threshold; and S5, detecting whether a boundary appears on the display panel, determining a mischarging time if so, and proceeding to step S2 if not.

Before step S1, the test method of the data mischarging of the display panel further includes:

connecting the optical test instrument to the display panel; and heating the display panel and proceeding to step S1 when a heating time of the display panel is greater than a second threshold.

In the test method of the data mischarging of the display panel, in the step of connecting the optical test instrument to the display panel, an optical detecting device of the optical test instrument is connected to a left side and a right side of the display panel.

Figure 3:
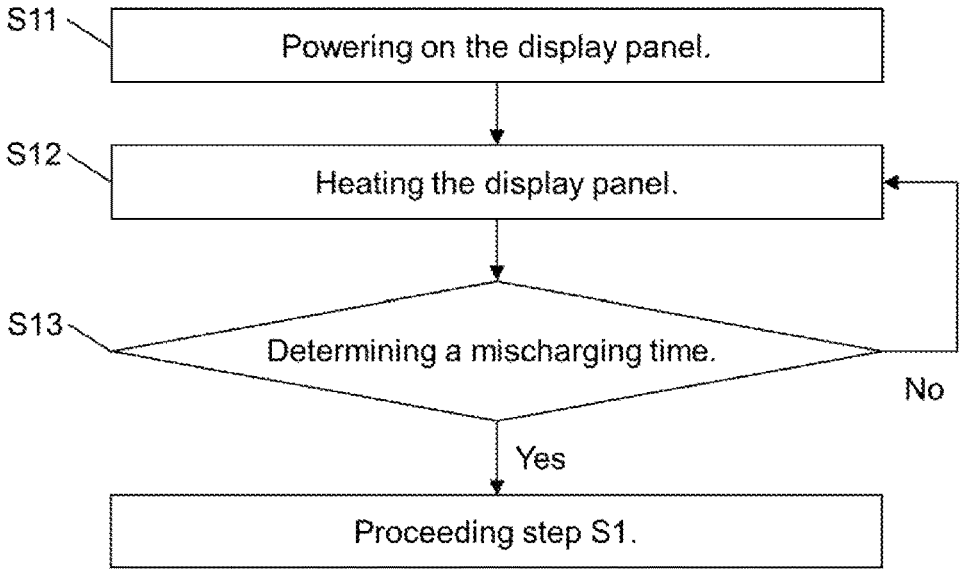
FIG. 3 is a flowchart of step S1 of the test method of the data mischarging of the display panel disclosed in an embodiment of the present invention.

As shown in FIG. 3, which is a flowchart of step S1 of the test method of the data mischarging of the display panel disclosed in an embodiment of the present invention, wherein the step of heating the display panel and proceeding to step S1 when the heating time of the display panel is greater than the second threshold further includes:

S11, powering on the display panel;

S12, heating the display panel; and

S13, determining whether the heating time of the display panel is greater than the second threshold, proceeding to step S1 if so, proceeding to step S12 if not.

In the test method of the data mischarging of the display panel, a heating efficiency of the display panel is accelerated by performing a functional operation. The functional operation includes and is not limited to reloading the screen.

In the test method of the data mischarging of the display panel, the charging time of the timing controller of step S3 is adjusted by adjusting a charging pulse width of the timing controller according to a charging pulse width sent by a micro control unit (MCU). The charging pulse width includes 5 ns or 10 ns.

In the test method of the data mischarging of the display panel, the screen with the solid color includes a solid green screen.

In the test method of the data mischarging of the display panel, the first threshold is arbitrarily determined, and the second threshold is one hour.

Between step S1 and step S2, the test method of the data mischarging of the display panel further includes: the PC turning off internal charging compensations of the master device and the timing controller through a bus.

Figure 4:
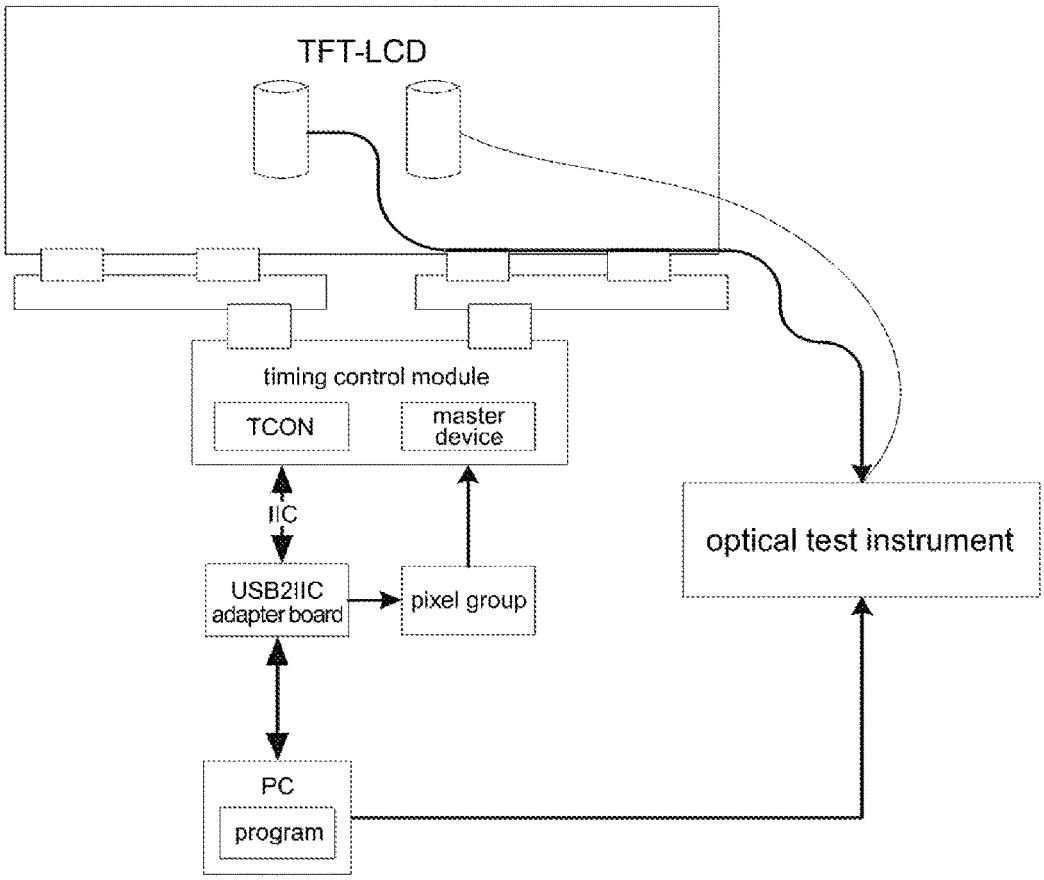
FIG. 4 is a structural diagram of a test device of the data mischarging of the display panel disclosed in an embodiment of the present invention.

As shown in FIG. 4, which is a structural diagram of a test device of the data mischarging of the display panel disclosed in an embodiment of the present invention, the test device of data mischarging of the display panel provided by the present invention includes a personal computer (PC), the display panel, an optical test instrument, a timing control module, a pixel group, a communication interface, and one or more programs. The one or more programs are stored in the PC and are configured to be executed by the timing control module. The one or more programs are configured to be executed by the timing control module for the steps of the above test method.

The PC is respectively connected to the communication interface (e.g., USB2IIC adapter board and IIC) and the optical test instrument. The communication interface is connected to the timing control module and the pixel group. The pixel group is connected to the timing control module. The timing control module is connected to the display panel (e.g., TFT-LCD). The display panel sends data to the optical test instrument.

The communication interface respectively communicates with the timing control module and the PC.

The pixel group is used to receive data sent by the communication interface.

The timing control module is used to receive data sent by the pixel group.

Figure 5:
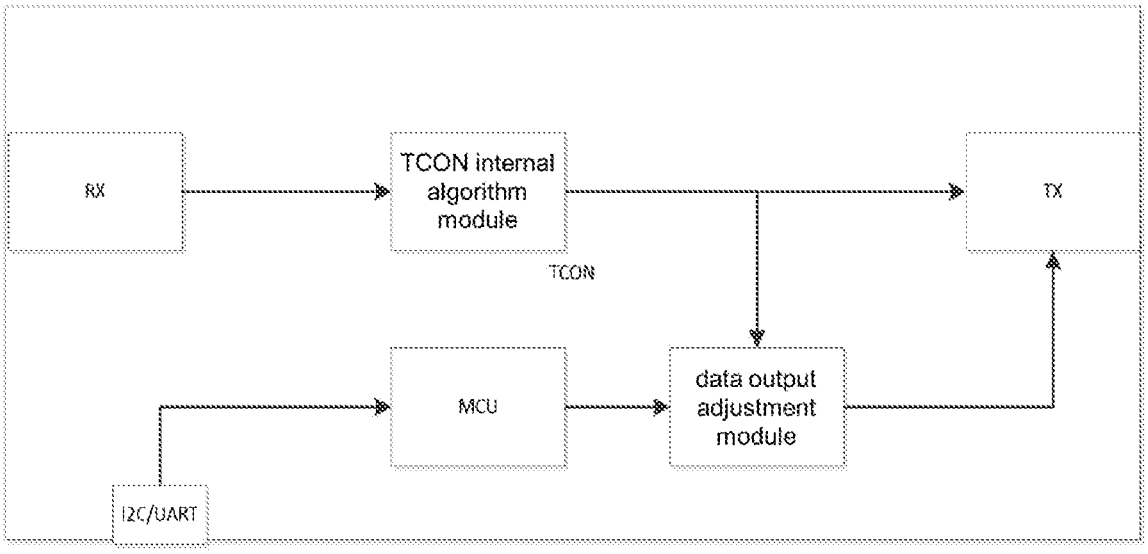
FIG. 5 is a structural diagram of a timing control module in the test device of the data mischarging of the display panel disclosed in an embodiment of the present invention.

FIG. 5 is a structural diagram of the timing control (TCON) module in the test device of the data mischarging of the display panel disclosed in an embodiment of the present invention.

The timing control module includes a timing control (TCON) internal algorithm module, the MCU, the communication interface (e.g., I2C/UART), a serial receiving unit RX, a serial sending unit TX, and a data output adjustment module. After receiving a first data sent by the communication interface, the MCU performs analysis process and sends the first data to the data output adjustment module.

Meanwhile, the serial receiving unit RX sends a second data to the timing control internal algorithm module, and the timing control internal algorithm module sends a processed data to the data output adjustment module and the serial sending module TX.

The data output adjustment module processes a received data and sends it to the serial sending module TX.

Figure 6:
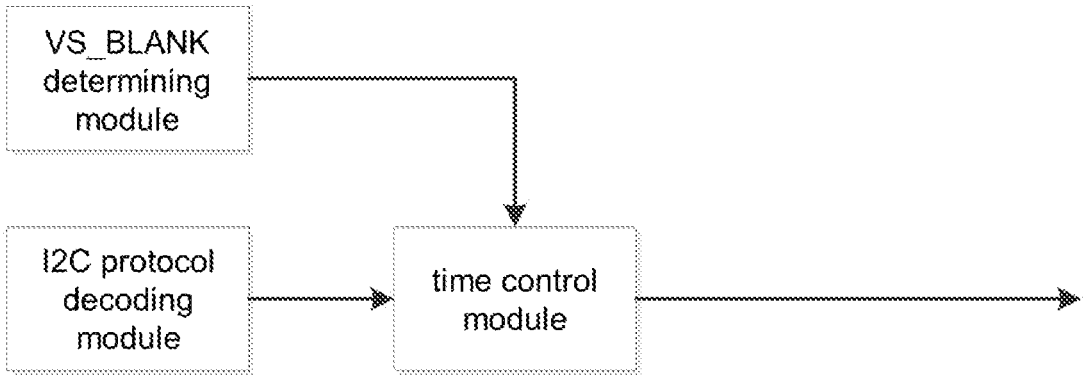
FIG. 6 is a structural diagram of a data output adjustment module of the timing control module in the test device of the data mischarging of the display panel disclosed in an embodiment of the present invention.

FIG. 6 is a structural diagram of the data output adjustment module of the TCON module in the test device of the data mischarging of the display panel disclosed in an embodiment of the present invention.

The data output adjustment module includes a VS_BLANK determining module, an I2C protocol decoding module and a time control module. The VS_BLANK determining module and the I2C protocol decoding module are respectively connected to the time control module.

Compared with the prior art, the embodiments of the present invention include the following beneficial effects:

the present invention provides the test method of the data mischarging of the display panel, which includes: the PC controlling the pixel group to output the screen with the solid color; controlling the charging time of the timing controller to be constant and updating the charging time of the master device to be same as the charging time of the timing controller; controlling the charging time of the master device to be constant and adjusting the charging time of the timing controller; and determining whether the measurement data of the optical test instrument is greater than the first threshold and detecting whether the boundary appears on the display panel, and determining the mischarging time if so. The present invention further provides the test device of the data mischarging of the display panel, which includes: the PC, the display panel, the optical test instrument, the timing controller module, the pixel group, the communication interface, and the one or more programs stored in the PC. The present invention can be used to quickly and effectively determine whether the data mischarging occurs to the display and can effectively obtain the mischarging time of data. According to the mischarging time, a technical problem of the data mischarging of the display panel in the prior art can be solved.

The device embodiments described above are only exemplary, and modules illustrated as separate components therein may be or may not be physically separated from each other, and components represented as modules may be or may not be physical modules, i.e., may be located in a same place or may be distributed in multiple network units. Some or all of the modules may be selected according to the actual requirements so as to achieve objectives of the present invention, which may be understood or implemented by those skilled in the art without creative work.

Through the foregoing description of the embodiments, it is clear to persons skilled in the art that, the embodiments may be implemented through software plus a necessary universal hardware platform or through hardware. Based on such an understanding, the foregoing technical solutions essentially, or the part contributing to the prior art may be implemented in the form of a software product. The computer software product may be stored in a computer readable storage medium such as a read-only memory (ROM), a random-access memory (RAM), a programmable read-only memory (PROM), an erasable programmable read-only memory (EPROM), a one-time programmable read-only memory (OTPROM), an electrically erasable programmable read-only memory (EEPROM), a compact disc read-only memory (CD-ROM), an optical disk memory, a magnetic disk memory, a magnetic tape memory, or any other computer-readable medium that can be configured to carry or store data.

Finally, it should be noted that embodiments of the present invention disclose the test method and the device of the data mischarging of the display panel, which disclose only the preferred embodiments of the present invention and are merely intended for describing the technical solutions of the present invention, but not for limiting the present invention. Although the present invention is described in detail with reference to the foregoing embodiments, persons of ordinary skill in the art should understand that they may still make modifications to the technical solutions described in the foregoing embodiments or make equivalent replacements to some or all technical features thereof, without departing from the scope of the technical solutions of the embodiments of the present invention.

What is claimed is:

1. A test method of data mischarging of a display panel, comprising:

S1, connecting an optical test instrument to the display panel and heating the display panel, and a personal computer (PC) controlling a pixel group to output a screen with a solid color through a bus when a heating time of the display panel is greater than a second threshold;

S2, the PC controlling a charging time of a timing controller to be constant and updating a charging time of a master device to be same as the charging time of the timing controller;

S3, the PC controlling the charging time of the master device to be constant and adjusting a charging pulse width of the timing controller according to a charging pulse width sent by a micro control unit to adjust the charging time of the timing controller;

S4, the PC determining whether a measurement data of the optical test instrument is greater than a first threshold, proceeding to step S5 if the measurement data of the optical test instrument is greater than the first threshold, and proceeding to step S2 if the measurement data of the optical test instrument is less than or equal to the first threshold; and S5, detecting whether a boundary appears on the display panel, determining a mischarging time if so, and proceeding to step S2 if not.

2. The test method of the data mischarging of the display panel according to claim 1, wherein in the step of connecting the optical test instrument to the display panel, an optical detecting device of the optical test instrument is connected to a left side and a right side of the display panel.

3. The test method of the data mischarging of the display panel according to claim 1, wherein step S2 is proceeded when the heating time of the display panel is less than the second threshold.

4. The test method of the data mischarging of the display panel according to claim 3, wherein a heating efficiency of the display panel is accelerated by performing a functional operation, and the functional operation comprises reloading the screen.

5. The test method of the data mischarging of the display panel according to claim 1, wherein the first threshold is arbitrarily determined, and the second threshold is one hour.

6. The test method of the data mischarging of the display panel according to claim 1, wherein between step S1 and step S2 further comprises:

the PC turning off internal charging compensations of the master device and the timing controller through the bus.

7. A test method of data mischarging of a display panel, comprising:

S1, a personal computer (PC) controlling a pixel group to output a screen with a solid color;

S2, the PC controlling a charging time of a timing controller to be constant and updating a charging time of a master device to be same as the charging time of the timing controller;

S3, the PC controlling the charging time of the master device to be constant and adjusting the charging time of the timing controller;

S4, the PC determining whether a measurement data of an optical test instrument is greater than a first threshold, proceeding to step S5 if the measurement data of the optical test instrument is greater than the first threshold, and proceeding to step S2 if the measurement data of the optical test instrument is less than or equal to the first threshold; and S5, detecting whether a boundary appears on the display panel, determining a mischarging time if so, and proceeding to step S2 if not.

8. The test method of the data mischarging of the display panel according to claim 7, wherein before step S1 further comprises:

connecting the optical test instrument to the display panel; and heating the display panel and proceeding to step S1 when a heating time of the display panel is greater than a second threshold.

9. The test method of the data mischarging of the display panel according to claim 8, wherein in the step of connecting the optical test instrument to the display panel, an optical detecting device of the optical test instrument is connected to a left side and a right side of the display panel.

10. The test method of the data mischarging of the display panel according to claim 8, wherein the step of heating the display panel and proceeding to step S1 when the heating time of the display panel is greater than the second threshold further comprises:

S11, powering on the display panel;

S12, heating the display panel; and

S13, determining whether the heating time of the display panel is greater than the second threshold, proceeding to step S1 if so, proceeding to step S12 if not.

11. The test method of the data mischarging of the display panel according to claim 10, wherein a heating efficiency of the display panel is accelerated by performing a functional operation, and the functional operation comprises reloading the screen.

12. The test method of the data mischarging of the display panel according to claim 8, wherein the first threshold is arbitrarily determined, and the second threshold is one hour.

13. The test method of the data mischarging of the display panel according to claim 7, wherein the charging time of the timing controller of step S3 is adjusted by adjusting a charging pulse width of the timing controller according to a charging pulse width sent by a micro control unit, and the charging pulse width comprises 5 ns or 10 ns.

14. The test method of the data mischarging of the display panel according to claim 7, wherein the screen with the solid color comprises a solid green screen.

15. The test method of the data mischarging of the display panel according to claim 7, wherein between step S1 and step S2 further comprises:

the PC turning off internal charging compensations of the master device and the timing controller through a bus.

16. A test device of data mischarging of a display panel, comprising a personal computer (PC), the display panel, an optical test instrument, a timing control module, a pixel group, a communication interface, and one or more programs;

wherein the one or more programs are stored in the PC and are configured to be executed by the timing control module, and the one or more programs are configured to be executed by the timing control module for:

the PC controlling the pixel group to output a screen with a solid color;

the PC controlling a charging time of a timing controller to be constant and updating a charging time of a master device to be same as the charging time of the timing controller;

the PC controlling the charging time of the master device to be constant and adjusting the charging time of the timing controller;

the PC determining whether a measurement data of the optical test instrument is greater than a first threshold, detecting whether a boundary appears on the display panel if the measurement data of the optical test instrument is greater than the first threshold, and the PC controlling the charging time of the timing controller to be constant and updating the charging time of the master device to be same as the charging time of the timing controller if the measurement data of the optical test instrument is less than or equal to the first threshold; and determining a mischarging time if the boundary appears on the display panel, and the PC controlling the charging time of the timing controller to be constant and updating the charging time of the master device to be same as the charging time of the timing controller if no boundary appears on the display panel.

17. The test device of the data mischarging of the display panel according to claim 16, wherein an optical detecting device of the optical test instrument is connected to a left side and a right side of the display panel.

18. The test device of the data mischarging of the display panel according to claim 16, wherein the PC controls the pixel group to output the screen with the solid color through a bus when a heating time of the display panel is greater than a second threshold; and the PC controls the charging time of the timing controller to be constant and updates the charging time of the master device to be same as the charging time of the timing controller when the heating time of the display panel is less than the second threshold.

19. The test device of the data mischarging of the display panel according to claim 18, wherein a heating efficiency of the display panel is accelerated by performing a functional operation, and the functional operation comprises reloading the screen.

20. The test device of the data mischarging of the display panel according to claim 18, wherein the first threshold is arbitrarily determined, and the second threshold is one hour.

* * * * *